US007976416B2

(12) United States Patent
Kobayashi et al.

(10) Patent No.: US 7,976,416 B2
(45) Date of Patent: Jul. 12, 2011

(54) GAME BALL

(75) Inventors: Takehiko Kobayashi, Tokyo (JP); Hironobu Yamamoto, Tokyo (JP); Takehiko Nishide, Tokyo (JP)

(73) Assignee: Tokyo Denki University, Tokyo (JP)

( * ) Notice: Subject to any disclaimer, the term of this patent is extended or adjusted under 35 U.S.C. 154(b) by 0 days.

(21) Appl. No.: 12/196,100

(22) Filed: Aug. 21, 2008

(65) Prior Publication Data

US 2009/0111619 A1 Apr. 30, 2009

(30) Foreign Application Priority Data

Oct. 31, 2007 (JP) ..... 2007-283385

(51) Int. Cl.
*A63B 41/00* (2006.01)

(52) U.S. Cl. ..... 473/570; 473/600

(58) Field of Classification Search ..... 473/570, 473/594, 577, 595, 600–602, 603–605; 273/156
See application file for complete search history.

(56) References Cited

U.S. PATENT DOCUMENTS

| | | | | | |
|---|---|---|---|---|---|
| 2,499,483 | A * | 3/1950 | Foy | 473/594 |
| 3,117,384 | A * | 1/1964 | Billis | 273/157 R |
| 3,406,972 | A * | 10/1968 | Wong | 473/570 |
| 3,854,719 | A * | 12/1974 | Supran | 473/570 |
| 4,299,384 | A * | 11/1981 | Van Auken | 473/570 |
| 4,718,670 | A * | 1/1988 | Gray | 473/570 |
| 4,886,273 | A * | 12/1989 | Unger | 273/157 R |
| 5,054,778 | A * | 10/1991 | Maleyko | 473/570 |
| 5,098,329 | A * | 3/1992 | Tseng | 473/610 |
| 5,127,652 | A * | 7/1992 | Unger | 273/157 R |
| 5,672,089 | A * | 9/1997 | Piera | 473/594 |
| 5,688,567 | A * | 11/1997 | Daulton | 428/11 |
| 6,241,249 | B1 * | 6/2001 | Wang | 273/156 |
| 6,666,782 | B1 * | 12/2003 | Wu | 473/570 |
| 2004/0094948 | A1 * | 5/2004 | Laurash et al. | 283/61 |
| 2006/0000127 | A1 * | 1/2006 | Schindele | 40/124.06 |

FOREIGN PATENT DOCUMENTS

JP 2000-280980 A 10/2000

* cited by examiner

*Primary Examiner* — Steven Wong
(74) *Attorney, Agent, or Firm* — Foley & Lardner LLP

(57) ABSTRACT

The invention provides a game ball, useful for children's safety, which can be detected far enough away a distance by a vehicle-onboard radar. The invention provides a game ball wherein a reflector member 12 is disposed within a spherical shell 13, the diagonal distance of the reflector member coincides with the inner diameter of the spherical shell, the reflector member has a shape constructed by combining three regular polygon plates 11A, 11B, 11C, the center angle of one side thereof being an integral submultiple of 90°, in such a manner that the centers of the three regular polygon plates are coincident and that the three regular polygon plates are perpendicular to each other, and a surface of said reflector member 12 is imparted with electromagnetic wave reflectivity.

4 Claims, 5 Drawing Sheets

GAME BALL

CROSS-REFERENCES TO RELATED APPLICATIONS

The entire disclosure of Japanese Patent Application No. 2007-283385, filed on Oct. 31, 2007, is expressly incorporated herein by reference.

BACKGROUND

1. Technical Field

The present invention relates to a game ball having radar reflectivity.

2. Related Art

There seems to be no end to unhappy automobile accidents caused by a child bursting into a road while engrossed in chasing a rolling game ball. The number of these accidents can be reduced by making the ball easier to be perceived earlier by the driver, even in dark roads, by imparting the surface of the ball with optical reflectivity and/or fluorescence, thus causing the ball to stand out in the light projected by headlights. Relying only on visual perception by the driver, however, is problematic in that seeing the ball is difficult when the latter is not far enough away and/or when visibility is poor.

Vehicle-onboard radars developed in recent years are being installed in ever more automobiles. Imparting radar reflectivity to a game ball allows the ball to be detected from far enough away by the vehicle-onboard radar of a running automobile when a game ball rolls into a poor-visibility road such as an alley and the like. The radar cross section afforded by just making the surface of the ball conductive, however, is small, and thus hard to detect by a vehicle-onboard radar. It is therefore necessary to provide the game ball with a large enough radar cross section. However, no game balls having a sufficiently large radar cross section, easy to detect by vehicle-onboard radars, have been known thus far.

Meanwhile, Japanese Patent Application Laid-open No. 2000-280980, for instance, discloses a rescue implement for vessels, comprising a black ball having a built-in reflector of large radar cross section. This conventional technology, however, is a rescue implement for vessels, which is a different technical field from game balls.

SUMMARY

In the light of the above problems of conventional technology, it is an object of the present invention to provide a game ball, useful for children's safety, which can be detected from far enough away by a vehicle-onboard radar.

The present invention is a game ball, wherein a reflector member is disposed within a spherical shell, the reflector member has a shape constructed by combining three regular polygon plates or circular plates of identical size in such a manner that the centers of the three regular polygon plates or circular plates are coincident and that the three regular polygon plates or circular plates are perpendicular to each other. The center angle of one side of the three regular polygon plates is an integral submultiple of 90°. A surface of the reflector member is imparted with electromagnetic wave reflectivity.

In the game ball of the above invention, the reflector member may be a conductor, a substrate which has a surface covered by a conductor, or a conductive net having apertures not greater than 0.5 mm.

Further, in the game ball of the above invention, the spherical shell and the reflector member may be made of a rubber pliable material.

The present invention is also a game ball which has octant sections that are obtained by forming a bisection of a sphere along a horizontal direction in the center of the sphere, and forming a quadrisection of the hemispheres along a vertical direction. A conductive cover is applied to each of three division surfaces on an outer surface excluding a spherical surface of the octant sections. The eight octant sections are combined into the sphere, and the sections are bonded together.

In the game ball of the above invention, the sphere may be made of a rubber pliable material.

In the present invention, a spherical shell has built therein a reflector member whose surface is imparted with electromagnetic wave reflectivity. The shape of the reflector member is constructed by combining three regular polygon plates or circular plates of identical size, the center angle of one side of the three regular polygon plates being an integral submultiple of 90°, in such a manner that the centers of the three plates are coincident and that the three plates are perpendicular to each other. Therefore, the resulting ball can comprise a spherical shell having built therein eight corner reflectors providing large radar cross section. This allows realizing a game ball having a radar cross section large enough to be easily detectable by a vehicle-onboard radar.

In the present invention, moreover, a conductive cover is applied to each of three division surfaces on the outer surface, excluding a spherical surface, of octant sections of a sphere, and the eight octant sections are combined into a sphere. Therefore, the resulting ball can comprise a spherical shell having built therein eight corner reflectors of large radar cross section. This allows realizing a game ball having a radar cross section large enough to be easily detectable by a vehicle-onboard radar. Moreover, a ball can formed by combining the octant sections into an eight-section assembly, and thus the game ball can be easily manufactured.

DESCRIPTION OF EXEMPLARY EMBODIMENTS

Embodiments of the present invention are explained next with reference to accompanying drawings.

First Embodiment

Figure 1:
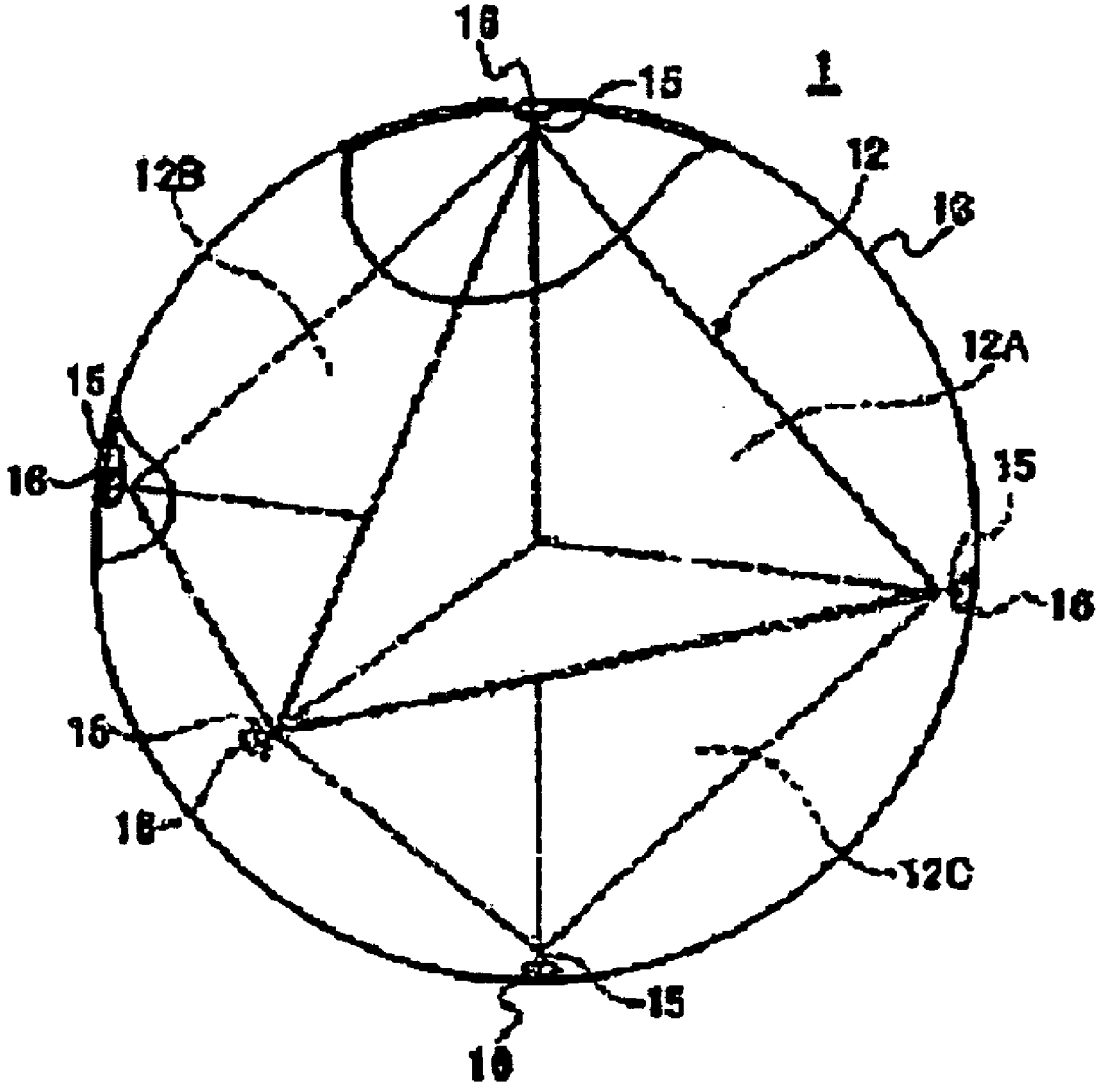
FIG. 1 is a partial cutaway perspective-view diagram of a game ball according to a first embodiment of the present invention.

A game ball 1 according to a first embodiment of the present invention will be explained with reference to FIGS. 1 and 2. The game ball 1 of the present embodiment has a spherical shell 13 and a reflector member 12 which is disposed within the spherical shell 13. The reflector member 12 has a shape which is constructed by combining three square plates of identical size, as regular polygon plates 11A, 11B, 11C, the center angle of one side of the three regular polygon plates being an integral submultiple of 90°, in such a manner that the centers of the three regular polygon plates are coincident and that the three regular polygon plates are perpendicular to each other. The diagonal distance of the reflector member 12 substantially coincides with the inner diameter of the spherical shell 13.

Figure 2:
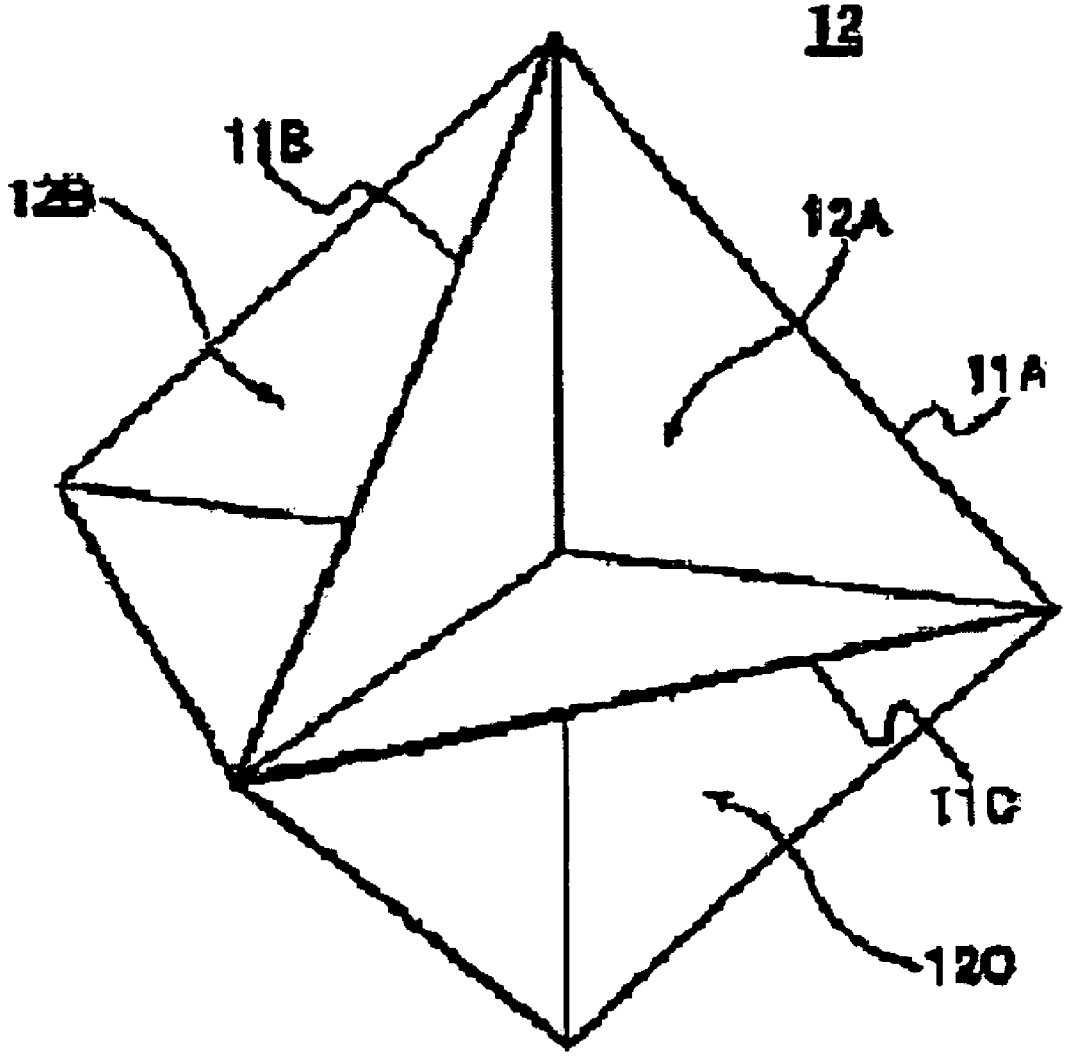
FIG. 2 is a perspective-view diagram of a reflector member built into the game ball of the embodiment.

The reflector member 12 is either a metal plate, a conductive resin plate, a mesh plate of metal or conductive resin plate having apertures of no greater than about 0.5 mm, or a fabric or a rubber pliable material that is attached with aluminum film, coating with a conducting material, or applied with a conductive material through, for instance, vapor deposition or the like. The reflector member 12 has electromagnetic wave reflectivity. The three regular polygon plates 11A, 11B, 11C form as a result four corner reflectors 12A, 12B, 12C, . . . offset from each other by 90° around a vertical axis, on the upper side and the lower side of FIG. 1 and FIG. 2.

The reflector member 12 may be the end result from putting together the three regular polygon plates 11A, 11B, 11C in such a manner that the latter are perpendicular to each other. Herein, the constitution of the components of the reflector member 12 is not particularly limited, provided that the assembly of the multiple components yields shapes such as those illustrated in the figures. For instance, members equivalent to the above-described four corner reflectors 12A, 12B, 12C, 12D may be joined together to be arranged as illustrated in FIG. 1. Alternatively, four reflector plates shaped as isosceles right triangles may be arranged on, and joined to, the front and reverse faces, respectively, of one horizontal square plate as the regular polygon plate 11C.

The spherical shell 13 is made of a material that can be used in children's games, for instance a rubber pliable material, or a plastic pliable material. The reflector member 12 is held in a suspended state, inside the interior of the spherical shell 13, by way of fixing cords 15, each of which is connected to one of the 6 apexes of the reflector member 12, to adhesive pieces 16, each of which is provided at six points, corresponding to the 6 apexes of the reflector member 12, on the inner surface of the spherical shell 13. The reflector member 12 becomes supported inside the spherical shell 13 in a suspended state, as illustrated in FIG. 1, when the spherical shell 13 of the game ball 1 of the present embodiment swells to a spherical shape by being filled with air.

The game ball 1 of the present embodiment affords the following advantages. For instance, in a soccer ball size having a diameter of 20 cm, the reflector member 12 yields a radar cross section of about 50 $m^2$ (frequency 76 GHz). This value is roughly identical to the radar cross section offered by the rear of a medium-sized motorcycle. Further, in a softball size having a diameter of 10 cm, the reflector member 12 yields a radar cross section of about 7 $m^2$ (frequency 76 GHz). For a soccer ball size, a vehicle-onboard radar can detect the ball at a point distant by about 100 m, and at a point distant by about 60 m for a softball size. The corner reflectors 12A, 12B, 12C, . . . are disposed, above and below, offset from each other by equal angles, to yield a structure comprising a built-in eight-section body. As a result, the structure can be acquired by radar regardless of the rotational attitude of the ball.

Figure 3:
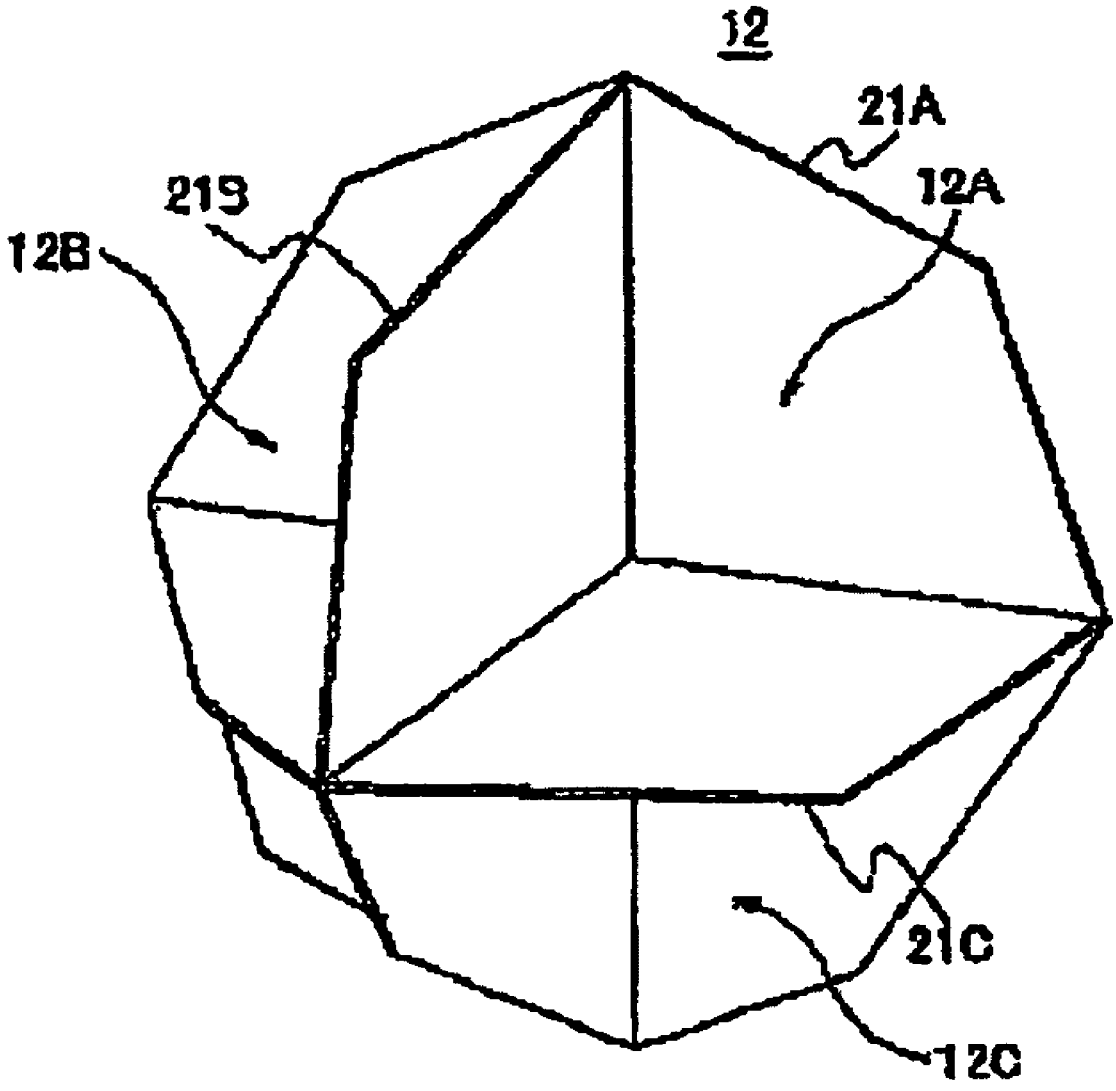
FIG. 3 is a perspective-view diagram illustrating a modification of the reflector member built into the game ball of the embodiment.
Figure 4:
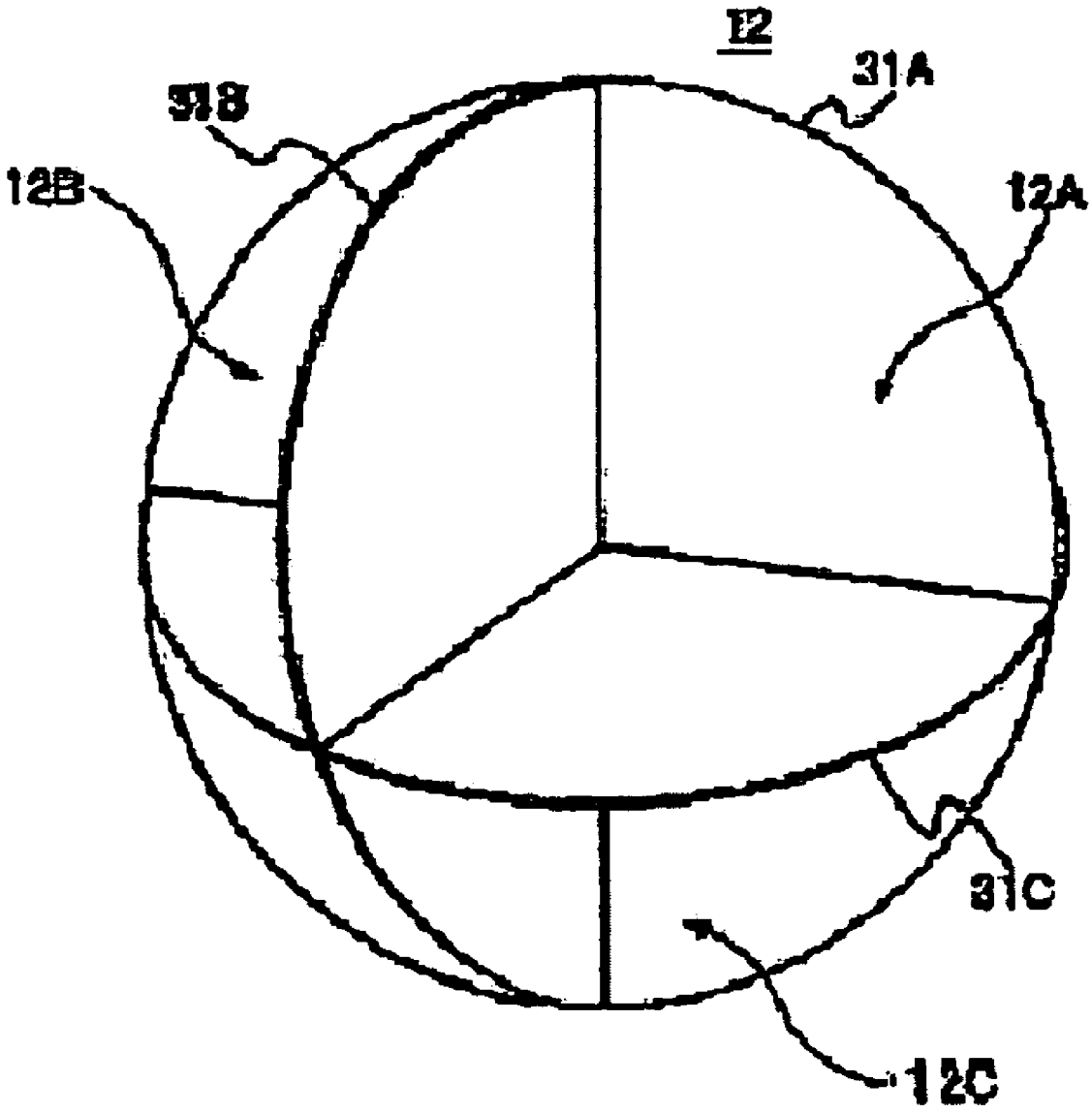
FIG. 4 is a perspective-view diagram illustrating another modification of the reflector member built into the game ball of the embodiment.

In the present invention, the reflector member 12 built into the spherical shell 13 may also be obtained by combining three octagonal plates 21A, 21B, 21C, as the regular polygon plates, in such a manner that the centers of the three plates are coincident and that the three plates are perpendicular to each other, as illustrated in FIG. 3. Alternatively, dodecagonal or hexadecagonal plates may also be used in the reflector member 12. The reflector member 12 built into the spherical shell 13 may also be obtained by combining three circular plates 31A, 31B, 31C, the centers of the three plates being coincident, in such a manner that the three plates are perpendicular to each other, as illustrated in FIG. 4.

Second Embodiment

Figure 5:
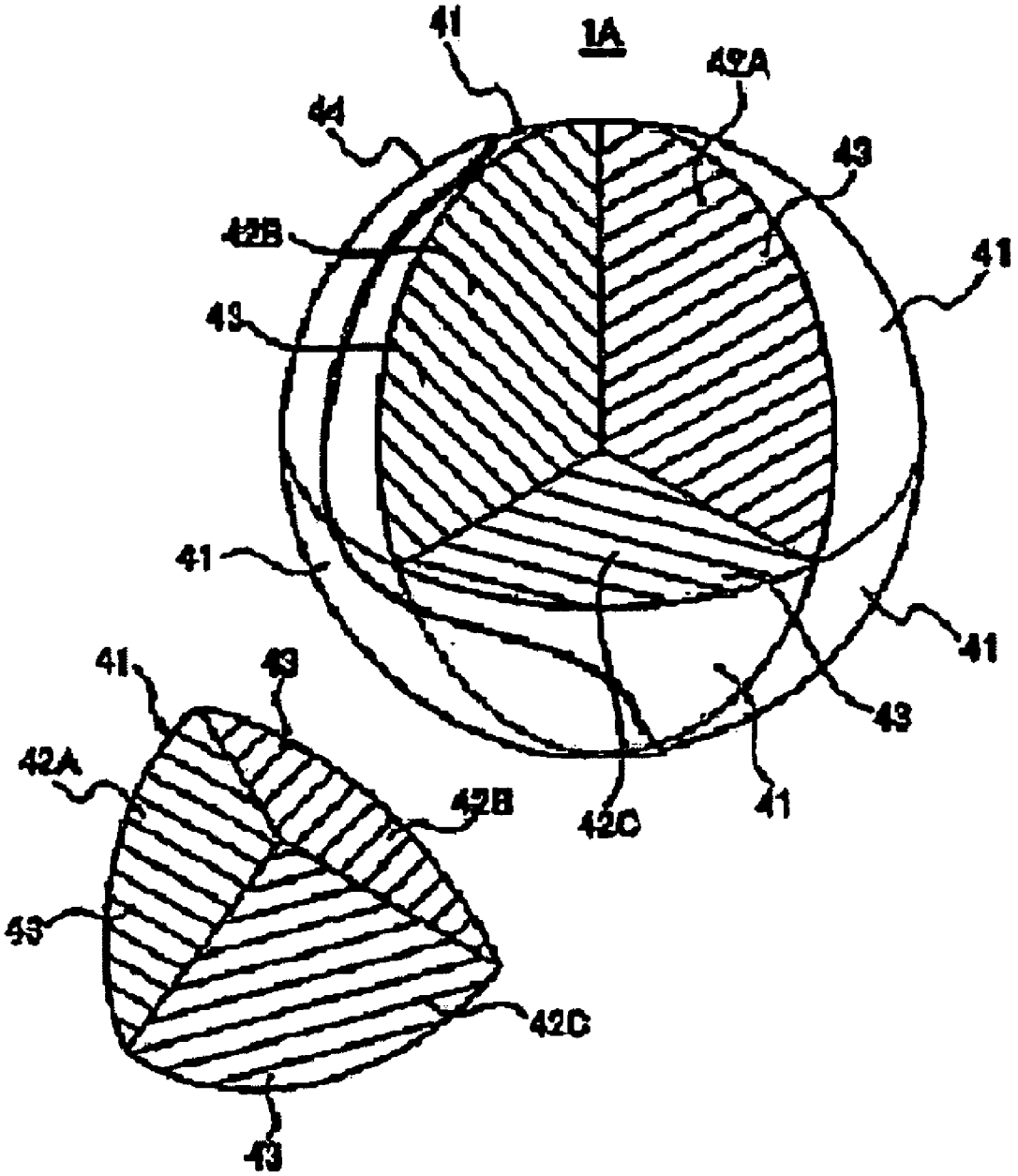
FIG. 5 is a partial cutaway perspective-view diagram of a game ball according to a second embodiment of the present invention, and a perspective-view diagram of a partial section of the game ball.

A game ball 1A of a second embodiment of the present invention is explained next with reference to FIG. 5. The game ball 1A of the present embodiment is made of a lightweight material such as styrene foam, a rubber pliable material, foamed rubber or the like, and the material is transparent to radar waves. Octant sections 41 are obtained by forming a bisection of a sphere along a horizontal direction in the center of the sphere, and forming a quadrisection of the hemispheres along two vertical directions. A conductive cover 43 is applied to each of three division surfaces 42A, 42B, 42C on an outer surface excluding a spherical surface of the octant sections. The eight octant sections 41 are combined into the sphere, and are covered with a skin 44 of pliable plastic, rubber or leather, to yield a ball.

As is the case in the first embodiment, in the game ball 1A of the present embodiment corner reflectors are likewise formed by the conductive cover 43 that is formed on the three divisional surfaces 42A, 42B, 42C, perpendicular to each other, of the outer surface of each octant section 41, excluding the spherical surface thereof. A radar cross section of about 50 $m^2$ (frequency 76 GHz) is obtained for a soccer ball size having a diameter of 20 cm, while a radar cross section of about 7 $m^2$ (frequency 76 GHz) is obtained for a softball size having a diameter of 10 cm. Moreover, the octant sections 41 yield a structure comprising a built-in eight-section body. As a result, the ball can be acquired by radar regardless of the rotational attitude of the ball. Moreover, a structure in which eight octant sections 41 are combined into a sphere, the skin 43 whereof is then covered, is easy to realize, which is advantageous.

The invention claimed is:

1. A game ball, wherein octant sections are obtained by forming a bisection of a sphere along a horizontal direction in the center of the sphere, and forming a quadrisection of the hemispheres along a first vertical direction and a second vertical direction, a conductive cover is applied to each of three division surfaces on an outer surface excluding a spherical surface of the octant sections, wherein the conductive cover covers each of the three division surfaces of the octant sections, wherein the eight octant sections are combined into the sphere, wherein the sections are bonded together, and wherein the game ball further comprises a leather outer cover that encases the sphere.

2. The game ball according to claim 1, wherein the sphere is made of a rubber pliable material.

3. The game ball according to claim 1, wherein the division surfaces are configured to form corner reflectors.

4. The game ball according to claim 3, wherein there are eight corner reflectors.

* * * * *